US005486087A

United States Patent [19]

Treiber et al.

[11] Patent Number: 5,486,087

[45] Date of Patent: Jan. 23, 1996

[54] UNIT FOR DELIVERING FUEL FROM A SUPPLY TANK TO AN INTERNAL COMBUSTION ENGINE

[75] Inventors: Juergen Treiber, Munich; Michael Kuehn, Bietigheim-Bissingen; Mathias Rollwage, Ditzingen; Dietrich Trachte, Leonberg; Willi Strohl, Beilstein, all of Germany

[73] Assignee: Robert Bosch GmbH, Stuttgart, Germany

[21] Appl. No.: 339,689

[22] Filed: Nov. 14, 1994

[30] Foreign Application Priority Data

Dec. 16, 1993 [DE] Germany ..... 43 43 078.3

[51] Int. Cl.[6] ..... F04D 29/40

[52] U.S. Cl. ..... 415/55.1; 415/55.2

[58] Field of Search ..... 415/55.1, 55.2, 415/55.5, 169.1

[56] References Cited

U.S. PATENT DOCUMENTS

| | | | |
|---|---|---|---|
| 4,591,311 | 5/1986 | Matsuda et al. . | |
| 4,793,766 | 12/1988 | Kumata | 415/169.1 |
| 5,192,184 | 3/1993 | Nobuo et al. | 415/55.1 |
| 5,215,429 | 6/1993 | Sun | 415/55.1 |
| 5,221,178 | 6/1993 | Yoshioka et al. | 415/55.1 |
| 5,328,325 | 7/1994 | Strohl et al. | 415/55.1 |
| 5,336,045 | 8/1994 | Koyama et al. | 415/55.1 |

FOREIGN PATENT DOCUMENTS

| | | | |
|---|---|---|---|
| 1194262 | 6/1965 | Germany | 415/55.1 |
| 4209126 | 11/1992 | Germany | 415/55.1 |
| 0270507 | 5/1970 | U.S.S.R. | 415/55.5 |

*Primary Examiner*—Edward K. Look
*Assistant Examiner*—Mark Sgantzos
*Attorney, Agent, or Firm*—Edwin E. Greigg; Ronald E. Greigg

[57] ABSTRACT

A unit for delivering fuel from a supply tank to an internal combustion engine, having a disklike impeller driven to revolve in a pump chamber, on whose circumference a number of blades are disposed, and having at least one supply conduit, disposed in the region of the impeller blades and open toward the impeller, in a chamber wall defining the pump chamber on the face end and axially adjoining the impeller, which supply conduit extends via a split ring around the pivot axis of the impeller from an inlet opening into the pump chamber to an outlet opening from it. In order to assure that sufficient fuel can be aspirated unthrottled in the presence of gas bubbles in the fuel, in particular when the fuel is hot, the supply conduit is embodied in the region of the inlet opening as larger by a factor of 2 than the usual supply conduit cross section; the cross section of the supply conduit then decreases continuously, beginning at the inlet end, forming a compression conduit.

18 Claims, 2 Drawing Sheets

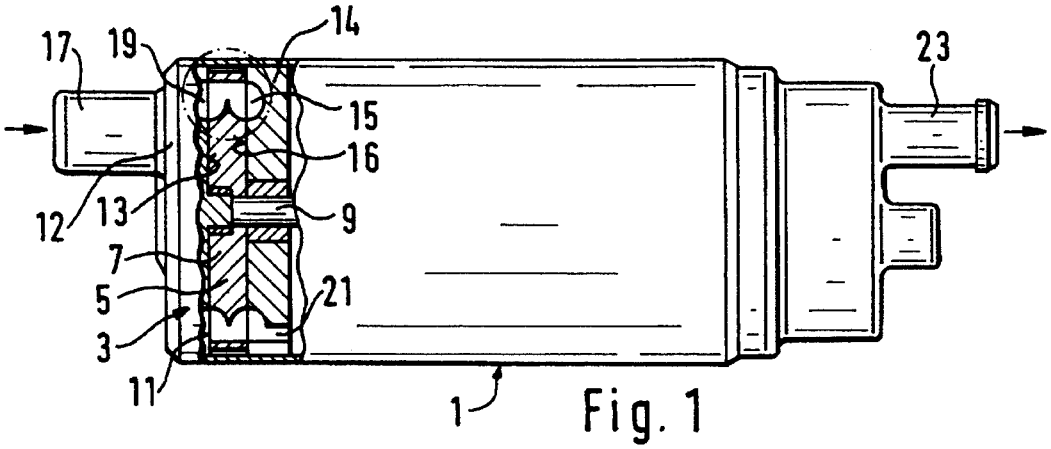
Fig. 1
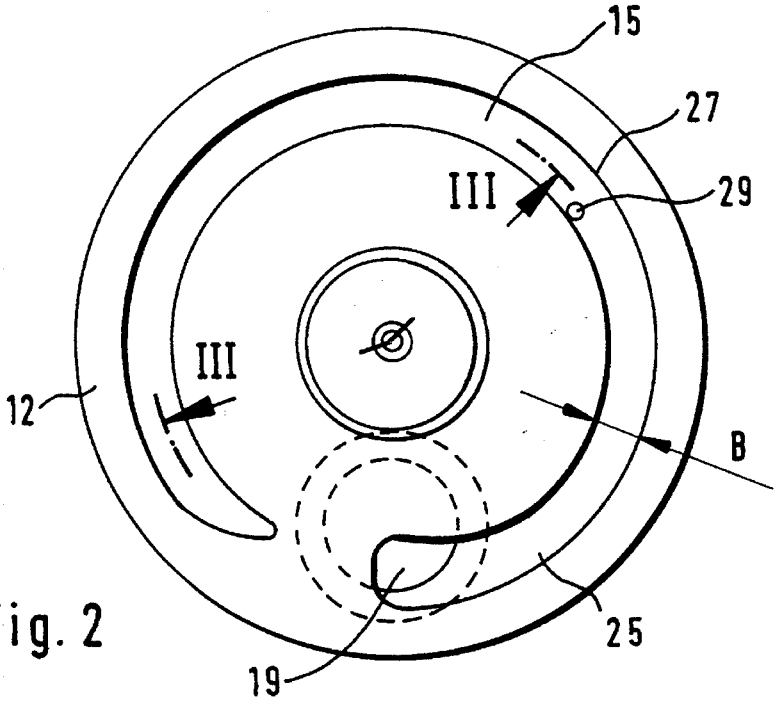
Fig. 2
Fig. 3
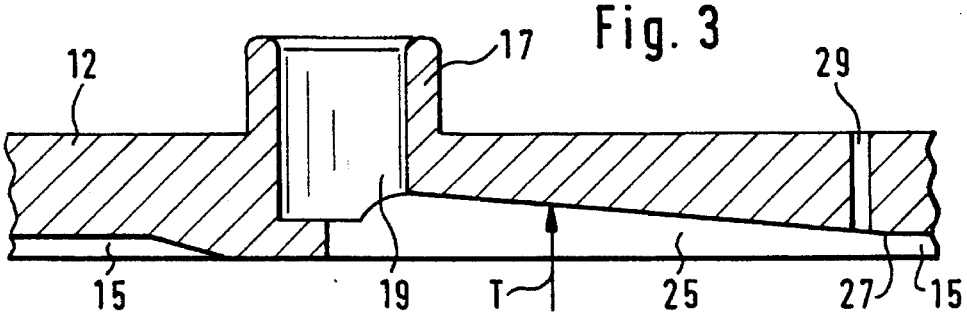

UNIT FOR DELIVERING FUEL FROM A SUPPLY TANK TO AN INTERNAL COMBUSTION ENGINE

BACKGROUND OF THE INVENTION

The invention relates to a unit for delivering fuel from a supply tank to an internal combustion engine. In one such supply unit, known from U.S. Pat. No. 4,592,311, an electric drive motor drives the impeller of a pump, embodied as a peripheral pump, to rotate. The disklike impeller, revolving in a cylindrical pump chamber, has a ring of blades, spaced apart from one another circumferentially of the impeller and ending at its two axially oriented end faces. In the chamber walls that define the pump chamber on the face ends, supply conduits are disposed via a split ring, at the level of the axially pointing blade ends, around the pivot axis of the impeller; they lead from an inlet opening to an outlet opening of the pump chamber, and the inlet opening is disposed in a first chamber wall, formed by an intake cap that closes off the pump, and the outlet opening is disposed in a second chamber wall, formed by an intermediate cap toward the drive motor. During operation of the known feed pump, the fuel is aspirated into the pump chamber via the inlet opening and pumped onward to the outlet opening via the supply conduit, with an increase in fuel pressure taking place as a result of the exchange of impetus between the fuel accelerated in the impeller and the fuel revolving in the supply conduit; from the outlet opening, the fuel is carried on to the engine that is to be supplied.

To allow unthrottled inflow of the requisite quantity of fuel into the supply conduit even if the proportion of gas bubbles in the aspirated fuel, in particular the hot fuel, is high, the supply conduit of the known fuel feed pump has an enlarged cross section at its end that covers the inlet opening; adjoining the inlet opening, this decreases via a step to a smaller cross section, which then extends constant over an angular range of approximately 70°. Adjoining this constant range, the cross section of the supply conduit decreases once again across a second step to a smaller value, which then again remains constant onward to the region of the outlet opening. For dissipating the gas bubbles from the supply conduit, a degassing bore communicating with a low-pressure chamber is provided in the first constant region of the supply conduit and opens into it a short distance from the second step.

However, the known delivery unit has the disadvantage that the gas bubbles aspirated into the supply conduit cannot be broken down completely or completely dissipated via the degassing bore, and hence they have a deleterious effect on the delivery characteristic, particularly when the fuel is hot, and also decrease pump efficiency.

OBJECT AND SUMMARY OF THE INVENTION

The unit according to the invention for delivering fuel from a supply tank to an internal combustion engine has the advantage over the prior art that the fuel entering the supply conduit is compressed uniformly in the region of the continuous cross-sectional reduction, in combination with the pressure increase of the revolving circulatory flow, so that the existing gas bubbles can be broken down quickly and reliably because of the pressure increase. The continuous cross-sectional reduction of the supply conduit has the advantage over the known pump above all that the reduction in fuel volume from the breakdown of the gas bubbles or air inclusions is taken into account, thus averting reformation of voids from an unnecessary idle volume in the supply conduit.

It is especially advantageous for the compression conduit created by the cross-sectional reduction to be extended over an angular range of approximately 90° to 130°, with the cross section of the supply conduit decreasing in the process by the factor of $\geqq 2$. This amount of cross-sectional reduction corresponds to the fuel volume on the one hand at low pressure at the inlet opening and on the other at elevated pressure at the end of the compression conduit, so that idle spaces can be reliably avoided; the portion of the supply conduit that follows the compression conduit extends at a constant cross section now merely has to assure the unhindered flow therethrough of liquid fuel.

The cross section of the compression conduit may decrease via a linear or progressive function; the linear decrease is preferably done via a decrease in the conduit depth. The transition to the remaining constant supply conduit cross section then takes place across a small step, which is moreover preceded by a degassing bore.

The progressive cross-sectional reduction is preferably effected via a continuous decrease in the conduit depth and width, with a gradual transition to the constant supply conduit cross section.

Because of the reliable breakdown of gas bubbles, a degassing bore in the supply conduit can be dispensed with; this has the advantage that the leakage quantity flowing out of the supply conduit via such a bore can be averted, which contributes to an increase in pump efficiency. In order nevertheless to be able to reliably dissipate the gas bubbles present in the pump when the delivery unit is started with hot fuel, the degassing bore is shifted to the web region remaining between the inlet and outlet openings.

To suit the various embodiments of conduits and impellers, the disposition of the compression conduit in pump types with a throttled overflow behavior between the supply conduits disposed in the chamber walls is limited to the conduit that has the intake opening, to avert the creation of additional idle space in the opposed conduit. In pump types in which the fuel entering at the inlet opening reaches the opposed supply conduit unthrottled, the compression conduit is provided in both supply conduits disposed in the opposed end chamber walls.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows a fuel delivery unit with a peripheral pump, shown in longitudinal section;

FIGS. 2 and 3 are two views of a first exemplary embodiment with a compression conduit whose cross section is reduced linearly;

DESCRIPTION OF THE PREFERRED EMBODIMENTS

Figure 4:
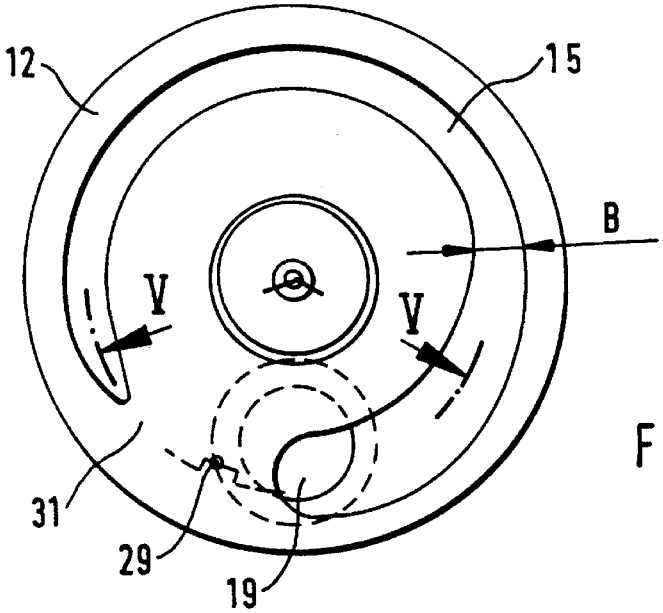
FIGS. 4 and 5 are two views of a second exemplary embodiment of the compression conduit whose cross section decreases progressively.

A unit 1 shown in FIG. 1 serves to deliver fuel from a supply tank, not shown, to an internal combustion engine, likewise not shown, of a motor vehicle. To that end, the delivery unit 1 has a feed pump 3, embodied as a peripheral pump, whose impeller 7, provided with a number of radially outward-extending blades 5, is driven to rotate by means of a shaft by an electric drive motor, not shown. The revolving, preferably circular-cylindrical impeller 7 is disposed in a pump chamber 11, which is defined in the axial direction of the impeller 7 by end pump chamber walls on both sides, of which a first pump chamber wall 13 is disposed on an intake cap 12 that closes off the feed pump 3 from the outside, and a second pump chamber wall 16 is disposed on an intermediate cap 14 demarcating the feed pump 3 from the drive motor. In each of the pump chamber walls 13, 16 there is a respective recess, forming a split ring of approximately 300° around the pivot axis of the impeller 7; together with the impeller 7, this recess forms a supply conduit 15, which leads from an inlet opening 19 on its one end, which opening communicates with an intake neck 17 on the intake cap 12, to an outlet opening 21 in the intermediate cap 14 on its other end; the fuel emerging from the supply conduit 15 as it flows onward flows through the delivery unit 1 and emerges from it at a pressure neck 23.

FIG. 2 shows the course of the supply conduit 15 in the intake cap 12. The supply conduit 15, as shown in FIG. 3 in a section indicated by the arrows in FIG. 2, has an enlarged cross section in the region of the inlet opening 19; in the first exemplary embodiment shown in FIGS. 2 and 3, this cross section is preferably formed by an increase in the conduit depth in the intake cap 12, and it is larger by approximately the factor of two than the usual supply conduit cross section in the region of the outlet opening 21.

This large cross section at the inlet end of the supply conduit 15 is designed such that the fuel, which at high temperatures and relatively low pressure has a high proportion of gas bubbles, can still be aspirated sufficiently unthrottled into the supply conduit 15.

From its inlet end, the cross section of the supply conduit 15 decreases continuously toward the outlet end, and in the region of this cross-sectional reduction it forms a compression conduit 25, which extends over an angular range of approximately 90° to 130° from the inlet end. This continuous cross-sectional reduction of the compression conduit 25, which is a component of the supply conduit 15, is effected in the first exemplary embodiment via a linear reduction in the conduit depth T at a substantially constant conduit width B. At its end remote from the inlet opening 19, the cross section of the compression conduit 25 has decreased to the amount of the remaining supply conduit region, and it merges with it at the transition 27, which is preceded by a degassing bore 29 inside the compression conduit 25. The degassing conduit begins at a low-pressure chamber and discharges into the pump chamber 11 in the region of the compression conduit 25. The transition 27 from the compression conduit 25 to the remaining supply conduit region 15 of constant cross section may alternatively be effected via a step or edge instead.

If the fuel that has a high proportion of gas bubbles is then pumped along the compression conduit 25, its pressure rises steadily, which in turn causes the proportion of gas bubbles to recede, until in the region of the transition 27 the fuel pressure has risen such that all the gas bubbles are compressed, and the cross section of the supply conduit 15 need merely assure the flow of the liquid fuel through it; the continuous cross-sectional reduction in the compression conduit 25 takes the decreasing space requirement of the fuel, as the pressure decreases, into account.

Any residual gas bubbles that may remain, particularly in hot starting of the unit 1, are reliably dissipated via the degassing bore 29 at the end of the compression conduit 25.

Figure 5:
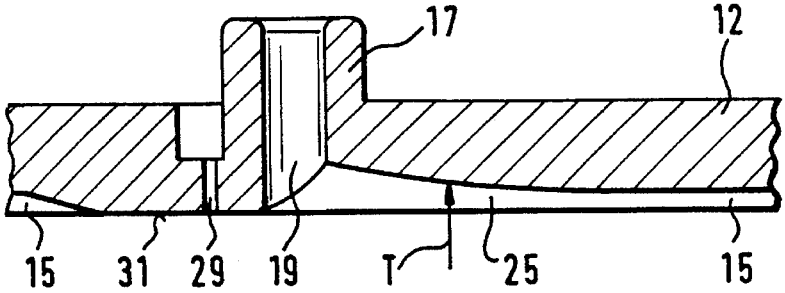

The second exemplary embodiment, shown in FIGS. 4 and 5 in views analogous to those of FIGS. 2 and 3, differs from the first exemplary embodiment solely in the design of the continuous cross-sectional reduction of the compression conduit 25 and in the disposition of the degassing bore 29.

The cross section of the compression conduit 25 in this embodiment progressively decreases in the conduit width B and the conduit depth T; the transition from the compression conduit 25 to the constant-cross section supply conduit region 15 is embodied to be gradual.

As a result of this embodiment of the compression conduit cross section, gas bubbles flowing into it can be broken down with certainty, so that the degassing bore 29 required for dissipating the gas bubbles at the start of the unit 1 can be shifted, in the second exemplary embodiment, into the region of a web 31 remaining between the inlet opening 19 and the outlet opening 21.

The second exemplary embodiment in particular has the advantage that the largest possible cross-sectional decrease is attained with still high-quality circulatory flow of the fuel in the supply conduit 15.

Figure 6:
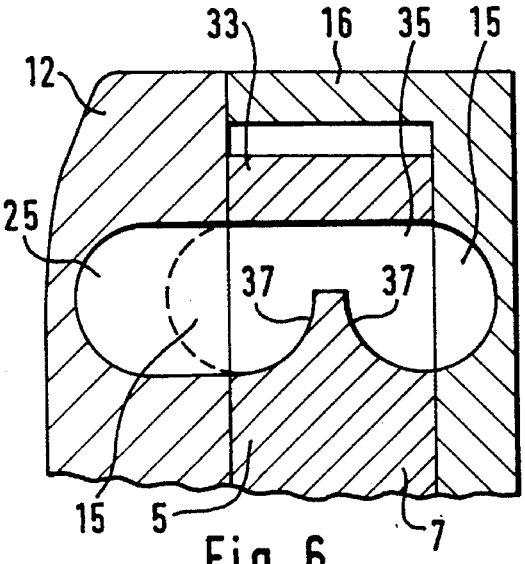
FIGS. 6 and 7 are enlarged details of FIG. 1, showing the disposition of the compression conduit with a closed impeller and an open impeller, respectively.

In the detail of FIG. 1 shown on a larger scale in FIG. 6, the impeller 7 has a ring 33, which radially closes the impeller 7, adjacent to the radial ends of the blades 5. The supply conduit 15 extends only over the region of the free blade ends; the blade chambers 35 formed between the individual blades 5 are bounded in the direction of the impeller axis by two concave cylindrical jacket faces 37 that intersect at the center of the impeller width, so that only a slight flow cross section at the impeller 7 is formed, by way of which the fuel can overflow from the supply conduit 15 located in the intake cap 12 and having the inlet opening 19 into the supply conduit 15 located in the intermediate cap 14 and having the outlet opening 21. In order not to create any additional idle spaces in the supply conduit 15 in the intermediate cap 14 as a consequence of a slow filling with fuel, the compression conduit 25 is provided only at the supply conduit 15 in the intake cap 12.

Alternatively, if the flow cross section at the impeller 7 is embodied as so great that the fuel flowing into the supply conduit 15 in the intake cap 12 through the inlet opening 19 can overflow unthrottled via the impeller 7 into the supply conduit 15 in the intermediate cap 14, then a compression conduit 25 is provided in the supply conduit 15 of the intermediate cap 14 as well, which compression conduit is opposite the compression conduit 25 in the supply conduit 15 of the intake cap 12.

Figure 7:
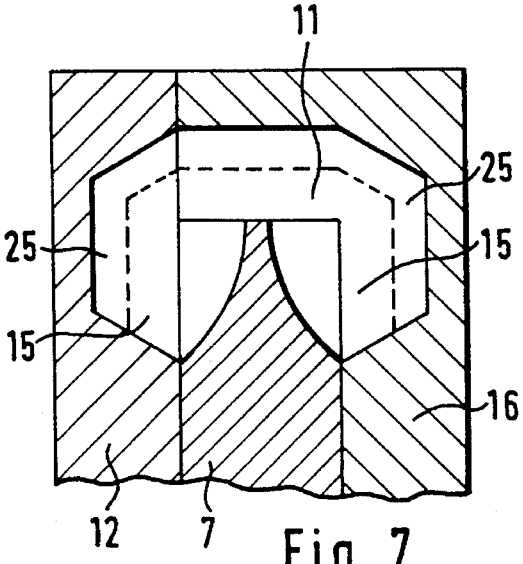

Compared with FIG. 6, the open impeller 7 shown in FIG. 7 has an additional overflow cross section between its radial end and the pump chamber wall, by way of which cross section the fuel flowing into the pump chamber 11 at the inlet opening 19 can continue unthrottled and rapidly to flow from the supply conduit 15 in the intake cap 12 into the supply conduit 15 in the intermediate cap 14, so that both supply conduits are filled identically, and for that reason compression conduits that are symmetrically opposite one another are provided there in both supply conduits 15.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A unit for delivering fuel from a supply tank to an internal combustion engine, comprising an intake cap (12), a disk-shaped impeller (7), that revolves in a pump chamber (11), a number of blades (5) extending radially outward are disposed on a circumference of said impeller, at least one supply conduit (15), which is open toward the impeller (7) and disposed in a region of the blades (5) of the impeller (7) in chamber walls (13 and 16) defining the pump chamber (11) on a face end and axially adjoining the impeller (7), said supply conduit (15) extends via a split ring around a pivot axis of the impeller (7) from an inlet opening (19) into the pump chamber (11) to an outlet opening (21) out of said pump chamber and has a different flow cross section in the flow course between the inlet opening (19) and the outlet opening (21), the cross section of the supply conduit (15), from an end that covers the inlet opening (19) toward the outlet end, decreases continuously over a certain angular range initially, forming a compression conduit (25), and once a certain value is reached continues constant as far as an end of the supply conduit (15) that covers the outlet opening (21), and between an inlet end and an outlet end of the supply conduit (15), a web (31) is formed in the intake cap (12) at a level of the blades (5) of the impeller (7), in which web a degassing bore (29) is provided that communicates with a low-pressure chamber.

2. The unit according to claim 1, in which the compression conduit (25), beginning on the inlet end of the supply conduit (15), extends over an angular range of approximately 90° to 130° in a direction of the outlet opening (21), and the entire supply conduit (15) extends over approximately 300° around the axis of the impeller (7).

3. The unit according to claim 1, in which a cross section of the compression conduit (25) is greater by at least a factor of two on its inlet end that covers the inlet opening (19) than on its outlet end remote from the inlet opening (19) and adjoining the remaining supply conduit (15).

4. The unit according to claim 2, in which a cross section of the compression conduit (25) is greater by at least a factor of two on its inlet end that covers the inlet opening (19) than on its outlet end remote from the inlet opening (19) and adjoining the remaining supply conduit (15).

5. The unit according to claim 1, in which a cross section of the compress ion conduit (25) decreases vertically to the chamber wall via a linear decrease in the conduit depth (T).

6. The unit according to claim 2, in which a cross section of the compression conduit (25) decreases vertically to the chamber wall via a linear decrease in the conduit depth (T).

7. The unit according to claim 3, in which a cross section of the compression conduit (25) decreases vertically to the chamber wall via a linear decrease in the conduit depth (T).

8. The unit according to claim 5, in which the compression conduit (25) changes into the constant-cross-section region of the supply conduit (15) via a transition (27) embodied as a step.

9. The unit according to claim 6, in which the compression conduit (25) changes into the constant-cross-section region of the supply conduit (15) via a transition (27) embodied as a step.

10. The unit according to claim 7, in which the compression conduit (25) changes into the constant-cross-section region of the supply conduit (15) via a transition (27) embodied as a step.

11. The unit according to claim 1, in which a cross section of the compression conduit (25) decreases via a progressive decrease in the depth (T) and width (B) of the conduit in a direction of the remaining supply conduit (15) and after attaining this cross section changes continuously thereto.

12. The unit according to claim 2, in which a cross section of the compression conduit (25) decreases via a progressive decrease in the depth (T) and width (B) of the conduit in a direction of the remaining supply conduit (15) and after attaining this cross section changes continuously thereto.

13. The unit according to claim 3, in which a cross section of the compression conduit (25) decreases via a progressive decrease in the depth (T) and width (B) of the conduit in a direction of the remaining supply conduit (15) and after attaining this cross section changes continuously thereto.

14. The unit according to claim 4, in which the degassing bore (29) that communicates with a low-pressure chamber discharges into the end of the compression conduit (25) remote from the inlet opening (19).

15. The unit according to claim 8, in which the degassing bore (29) that communicates with a low-pressure chamber discharges into the end of the compression conduit (25) remote from the inlet opening (19).

16. The unit according to claim 1, in which between a radially outward-pointing circumferential face of the impeller (7) and a wall of the pump chamber (11), an overflow cross section remains, by way of which the fuel can overflow virtually unthrottled from the supply conduit (15), having the inlet opening (19), in a first chamber wall (13) into the supply conduit (15) symmetrically opposing the inlet opening in a second chamber wall (16) that has the outlet opening (21), and one compression conduit (25) each, symmetrically opposite one another, is provided in the two supply conduits (15).

17. The unit according to claim 1, in which a radially outward-pointing ends of the blades (5) of the impeller (7) are joined to one another by means of a ring (33) radially surrounding the impeller (7), and that the supply conduits (15), extending across the region of the free blade ends, communicate hydraulically with one another in the pump chamber walls (13, 15) via a slight flow cross section at the impeller (7), and a compression conduit (25) is provided only in the supply conduit (15) that has the inlet opening (19).

18. The unit according to claim 1, in which a radially outward-pointing end of the blades (5) of the impeller (7) communicate with one another by means of a ring (33) radially surrounding the impeller (7), and that the supply conduits (15) extending via the region of the free blade ends communicate hydraulically with one another in the pump chamber walls (13, 15) via the impeller (7), and one compression conduit (25) each, opposite one another, is provided in both supply conduits (15).

* * * * *